US011014130B2

(12) United States Patent
Deng et al.

(10) Patent No.: US 11,014,130 B2
(45) Date of Patent: May 25, 2021

(54) INTEGRATED PAINT BUCKET CLEANING AND DRYING MACHINE

(71) Applicant: DONGGUAN UNIVERSITY OF TECHNOLOGY, Dongguan (CN)

(72) Inventors: Jun Deng, Dongguan (CN); Shouyan Zhong, Dongguan (CN)

(73) Assignee: DONGGUAN UNIVERSITY OF TECHNOLOGY, Dongguan (CN)

( * ) Notice: Subject to any disclaimer, the term of this patent is extended or adjusted under 35 U.S.C. 154(b) by 171 days.

(21) Appl. No.: 16/286,254

(22) Filed: Feb. 26, 2019

(65) Prior Publication Data

US 2019/0381541 A1 Dec. 19, 2019

(30) Foreign Application Priority Data

Jun. 15, 2018 (CN) ..... 201810622755.3
Dec. 26, 2018 (JP) ..... 2018-243743

(51) Int. Cl.
*B08B 9/36* (2006.01)
*B08B 9/08* (2006.01)
*F26B 5/16* (2006.01)

(52) U.S. Cl.
CPC ..... *B08B 9/36* (2013.01); *B08B 9/0808* (2013.01); *B08B 9/0813* (2013.01); *F26B 5/16* (2013.01);
(Continued)

(58) Field of Classification Search
CPC . A46B 13/00; A46B 2200/3006; B08B 13/00; B08B 9/0808; B08B 9/0813;
(Continued)

(56) References Cited

U.S. PATENT DOCUMENTS

2018/0236508 A1* 8/2018 Montalbano ..... B08B 9/0826
2018/0242722 A1* 8/2018 Patterson ..... B08B 9/087
2020/0130032 A1* 4/2020 Lin ..... B08B 9/0826

FOREIGN PATENT DOCUMENTS

CN 103350089 A * 10/2013
CN 108246749 A * 7/2018
(Continued)

OTHER PUBLICATIONS

CN-103350089-A—English Machine Translation (Year: 2013).*

*Primary Examiner* — Marc Carlson
(74) *Attorney, Agent, or Firm* — Law Offices of Steven W. Weinrieb

(57) ABSTRACT

The present invention relates to an integrated paint bucket cleaning and drying machine, including a frame and a conveying carrier tape, the conveying carrier tape is disposed with a loading port matching with the paint bucket. The upper part of the frame is sequentially provided with a cleaning mechanism and a drying mechanism and on the frame located under the cleaning mechanism and the drying mechanism is disposed a fixing device. The cleaning mechanism includes a cleaning lift cylinder disposed on the frame, a cleaning machine matching with the paint bucket is connected below the cleaning lift cylinder, and the cleaning lift cylinder is matched with the cylinder rotating device disposed on the frame. The drying mechanism includes a drying lift cylinder disposed on the frame, a drying machine matching with the paint bucket is connected below the drying lift cylinder. The drying lift cylinder is matched with cylinder rotating device disposed on the frame. The invention adopts a tightly conveyed conveying carrier tape as a carrier to continuously move the paint buckets, and matching with the cleaning mechanism and the drying mechanism to realize continuous and automatic cleaning and drying,
(Continued)

greatly improving the efficiency of cleaning and drying the paint bucket.

10 Claims, 6 Drawing Sheets

(52) U.S. Cl.
CPC ..... *B08B 9/0821* (2013.01); *F26B 2210/00* (2013.01)

(58) Field of Classification Search
CPC ..... B08B 9/0821; B08B 9/0826; B08B 9/36; F26B 2210/00; F26B 5/16
See application file for complete search history.

(56) References Cited

FOREIGN PATENT DOCUMENTS

| | | | | | |
|---|---|---|---|---|---|
| CN | 109530356 | A | * | 3/2019 | |
| EP | 1800766 | A1 | * | 6/2007 | ..... B44D 3/006 |
| JP | 57113368 | A | * | 7/1982 | ..... B01L 13/02 |
| JP | 11151470 | A | * | 6/1999 | |

* cited by examiner

INTEGRATED PAINT BUCKET CLEANING AND DRYING MACHINE

FIELD OF THE INVENTION

The present invention relates generally to the field of cleaning equipment, and more particularly to a paint bucket cleaning and drying integrated machine.

BACKGROUND OF THE INVENTION

With the acceleration of the urbanization process, a large number of houses need to be renovated, and most of the renovations will use paint in the bucket, wherein large paint buckets are mainly used on the construction site. The large paint bucket is good in quality, and is more durable than the common household plastic bucket, therefore is widely used by the workers. Every spring festival, some workers carry paint buckets by train home. The structure of the paint bucket is generally as shown in FIG. 1 and includes a cylindrical bucket body 7; and a hook mounting block 8 is disposed on an outer side of the upper part of the bucket body 7. The hook mounting block 8 is mounted with a hook 9 used for lifting. In order to adapt to different environments, the bottom of the bucket body 7 mostly has a fixing cavity 10 which is open downward. It is necessary to clean the paint buckets with paint cleaning solutions to make the use of the paint bucket safer. The existing cleanings methods is to wipe with a rag, which is inefficient and requires two steps of scrubbing and drying, and it is time consuming and laborious.

SUMMARY OF THE INVENTION

The object of the present invention is to provide a paint bucket cleaning and drying integrated machine, adopting a tightly conveyed conveying carrier tape as a carrier to continuously move the paint bucket, and matching with the cleaning mechanism and the drying mechanism to realize continuous and automatic cleaning and drying, greatly improving the efficiency of cleaning and drying the paint bucket.

In order to achieve the above object, the technical solutions adopted by the present invention are:

The paint bucket cleaning and drying integrated machine including a frame, and in the middle part of the frame is disposed a tightly conveying carrier tape which is conveying from left to right. The conveying carrier tape is disposed with a loading port matching with the paint bucket. The upper part of the frame is sequentially provided with a cleaning mechanism and a drying mechanism matched with the paint bucket in the conveying direction. And the frame under the cleaning mechanism and the drying mechanism is provided with a fixing device matching with a fixing cavity disposed under the paint bucket. The cleaning mechanism includes a cleaning lift cylinder disposed on the frame, a cleaning machine matching with the paint bucket is connected below the cleaning lift cylinder, and the cleaning lift cylinder is matched with a cylinder rotating device disposed on the frame. The drying mechanism includes a drying lift cylinder disposed on the frame, and a drying machine matching the paint bucket is connected under the drying lift cylinder, and the drying lift cylinder is matched with the cylinder rotating device disposed on the frame.

Further, the drying machine includes a drying connect block connected with the drying lift cylinder. A drying sleeve is fixedly connected to the bottom of the drying connect block. The outer side of the drying sleeve is sleeved with a detachable drying cloth cover matched with the paint bucket. Further, the inside of the drying sleeve is a cavity, and a lift plate return spring is disposed at the bottom thereof. The upper part of the lift plate return spring is connected with a discharge tube lift plate sealed with the drying sleeve. The middle part of the discharge tube lift plate is fixedly connected with an activated carbon discharge tube penetrating thereof. The bottom of the drying connect block is fixedly connected with a discharge tube sealing sleeve which is sealingly matched with the activated carbon discharge tube. And the drying connect block is provided with an activated carbon discharge channel communicated with the activated carbon discharge tube and a discharge tube lift air passage communicated with the drying sleeve. The outer end of the discharge tube lift air passage is connected with a discharge tube lift air pump, the middle part of the bottom of the drying sleeve and the drying cloth sleeve are respectively provided with holes that are sleeved and matched with the activated carbon discharge tube. The lower part of the activated carbon discharge tube is provided with an activated carbon discharge port, and the bottom thereof is connected with a drying block. The activated carbon discharge port is sealed by the bottom plate of the drying sleeve while the bottom of the drying block 55 is flush with the drying cloth cover.

Further, the cleaning machine includes a cleaning connect block disposed under the cleaning lift cylinder. And a cylindrical cleaning mounting net is fixedly connected under the cleaning connect block, the outer side of the cleaning mounting net is sleeved with a sponge layer. The outer side of the sponge layer is provided with a brush layer, and the brush of the brush layer is connected to the cleaning mounting net passing through the sponge layer.

Further, the part of the cleaning connect block that is located within the cleaning mounting net is sealed and fixedly connected with a water storage tank. The water storage tank is provided with a pressurizing plate sealed and matched thereof. The cleaning connect block is provided with a pressurizing air passage matched with the cavity of the water storage tank, and the cavity is located above the pressurizing plate. The pressurizing air passage is connected with a pressurizing joint, the side wall and the lower plate of the water storage tank are embedded with a pressurizing control valve, and a liquid spray head is connected with the outer end of pressurizing control valve.

Further, a liquid supplementing tube passing through the pressurizing plate is disposed under the cleaning connect block, and the liquid supplementing tube is sealed and sleeved with the cleaning connect block. The cleaning connect block is provided with a liquid supplementing channel communicated with the liquid supplementing tube, the liquid supplementing channel is connected with a supplementing joint.

Further, the side wall of the water storage tank is also embedded with a pressurizing control valve, and the said side wall is located above the pressurizing plate. The pressurizing control valve is communicated with a cavity of the water storage tank through an upper liquid discharge channel disposed on the side wall of the water storage tank, and the cavity is located below the pressurizing plate.

Further, the cylinder rotating device includes a cylinder limit sleeve, which is provided on the upper part of the frame and is sleeved and matched with the cleaning lift cylinder or drying lift cylinder, and includes a driven gear, which is sleeved with the cleaning lift cylinder or drying lift cylinder. The upper part of the driven gear is provided with a gear fixing block which is fixedly connected to the side wall of the cleaning lift cylinder or drying lift cylinder through a gear fixing bolt. The driven gear is meshed and matched with a drive gear, the drive gear is sleeved with a cylinder rotating motor provided on the frame.

Further, the fixing device includes a fixing lift cylinder disposed under the frame, the fixing lift cylinder is provided with a fixing seat, and the fixing seat is provided with an inner fixing cylinder. The inner fixing cylinder is connected with an inner fixing arc plate matched with the inner wall of the fixing cavity. A suction pump is disposed above the inner fixing cylinder, and a conical suction cone sleeve matched with the bottom plate of the bucket is disposed above the suction pump.

Further, the lower part of the frame is provided with a block support seat, the lower part is located under the fixing seat. The inside of the said block support seat is provided with a fixing support port, the fixing support port is provided with a fixing support spring. And the fixing support spring is provided with a fixing support rod, and the lower part of the fixing support rod is provided with a fixing limit ball, the lower surface of the fixing seat is provided with a fixing limit arcing port matched with the fixing limit ball.

The beneficial effects of the invention are:

The present invention adopts a conveying carrier tape which is tightly conveyed as a carrier for continuously moving the paint bucket, and cooperates with the cleaning mechanism and the drying mechanism to realize continuous automatic cleaning and drying, greatly improving the efficiency of cleaning and drying the paint bucket.

The drying machine is simple in structure and convenient in operation, and the drying sleeve is convenient to replace.

The structural design of the activated carbon feeding part is ingenious, which uses the air pressurizing and the return spring to realize the lifting of the activated carbon feeding pipe, thereby realizing the feeding of the activated carbon, and the peculiar smell is adsorbed and removed by the activated carbon after drying, further improve the overall effect of cleaning and drying.

The cleaning machine adopts the structure that a brush layer and a sponge layer are matched with each other, which may achieve a good cleaning and washing effect without causing waste of the cleaning solution.

The design of the water storage tank and the liquid spray head can replenish the sponge layer with the paint cleaning solution to ensure that the cleaning machine has a continuous good cleaning ability; the design of the pressurizing plate and the pressurizing air passage matched with the pressurizing control valve can realize the liquid spay by adding joints to communicate the pressurizing pump.

The design of the liquid supplementing tube and the liquid supplementing channel can replenish the paint cleaning solution in the water storage tank without affecting the pressurizing liquid spray.

The design of the upper liquid spray channel matching the upper liquid spay head of the water storage tank can spay liquid to the upper part of the sponger layer without affecting the operation of the pressurizing liquid spray.

The structure of the cylinder rotating device is ingeniously designed to realize the rotation of the cleaning lift cylinder and drying lift cylinder and meanwhile is easy to disassemble and replace.

The design of the fixing device can clamp the inner side plate of the fixing cavity and meanwhile, can closely connect the bottom plate of the bucket with the suction taper sleeve by suction of the suction pump.

The structure of the fixing support part is ingeniously designed to share the pressure of the fixing seat to the fixing lift cylinder.

The drawings include the following components:

1. Frame;
2. Fixing device;
3. Paint bucket;
4. Cleaning lift cylinder;
5. Cleaning machine;
6. Cylinder rotating device;
7. Bucket body;
8. Hook mounting block;
9. Hook;
10. Fixing cavity;
11. Cleaning connect block;
12. Cleaning mounting net;
13. Sponger layer;
14. Brush layer;
15. Water storage tank;
16. Liquid supplementing tube;
17. Liquid supplementing channel;
18. Liquid supplementing joint;
19. Liquid spay head;
20. Pressurizing plate;
21. Pressurizing air passage;
22. Pressurizing joint;
23. Pressure control valve;
24. Upper liquid spay channel;
25. Cylinder limit sleeve;
26. Driven gear;
27. Gear fixed block;
28. Gear fixed bolt;
29. Drive gear;
30. Cylinder rotating motor;
31. Fixing lift cylinder;
32. Fixing seat;
33. Inner fixing cylinder;
34. Inner fixing arc plate;
35. Suction pump;
36. Suction cone sleeve;
37. Material support seat;
38. Material support spring;
39. Material support rod;
40. Material limit ball;
41. Conveying carrier tape;
42. Drying lift cylinder;
43. Drying machine;
44. Drying connect block;
45. Drying sleeve tank;
46. Drying cloth sleeve;
47. Activated carbon feed tube;
48. Activated carbon discharge channel;

49. Discharge tube sealing sleeve;
50. Discharge tube lift plate;
51. Discharge tube lift air passage;
52. Discharge tube lift air pump;
53. Lift plate return spring;
54. Activated carbon discharge port;
55. Drying block.

DETAILED DESCRIPTION OF THE ILLUSTRATED EMBODIMENT

The present invention will be described in detail below with reference to the accompanying drawings, and the description of the present invention is only exemplary and explanatory, and should not be construed as limiting the scope of the present invention.

Figure 1:
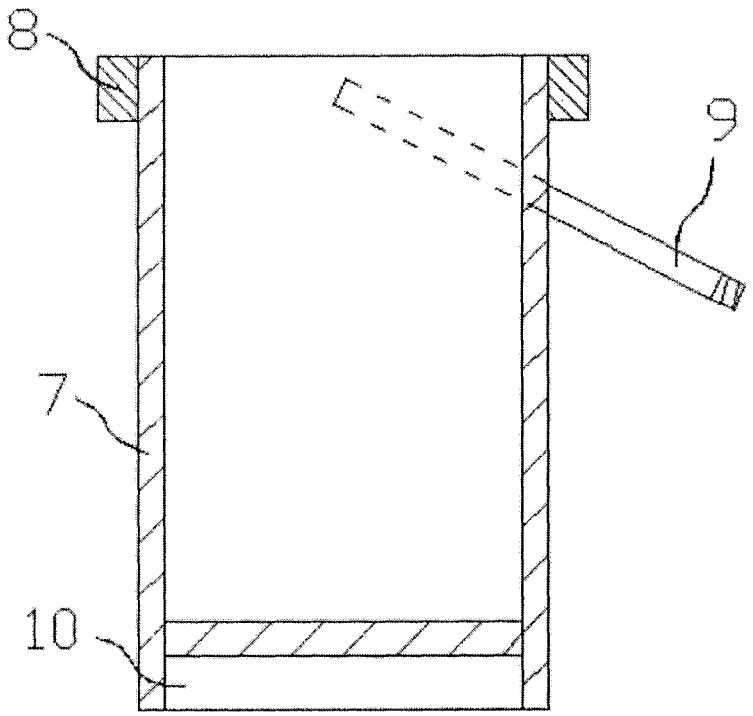
FIG. 1 is a schematic structural view of the structure of a paint bucket.
Figure 2:
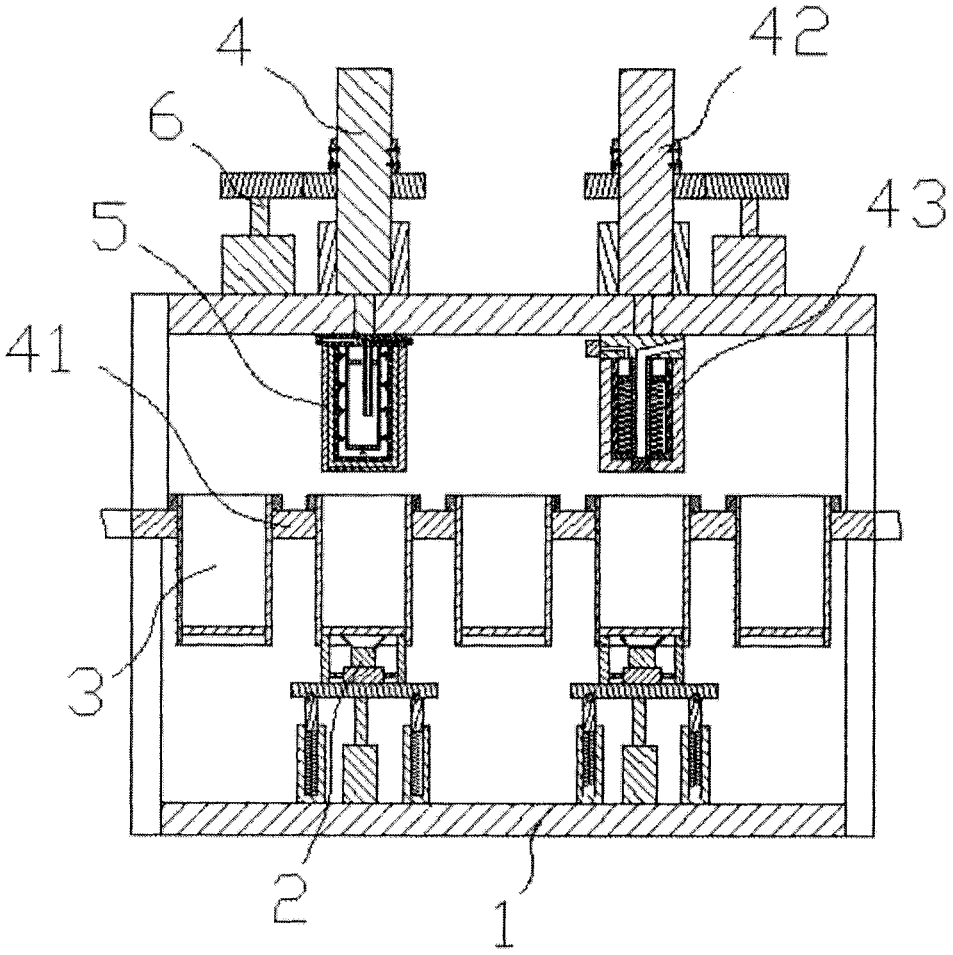
FIG. 2 is a schematic structural view of a cleaning and drying integrated machine for paint bucket.
Figure 3:
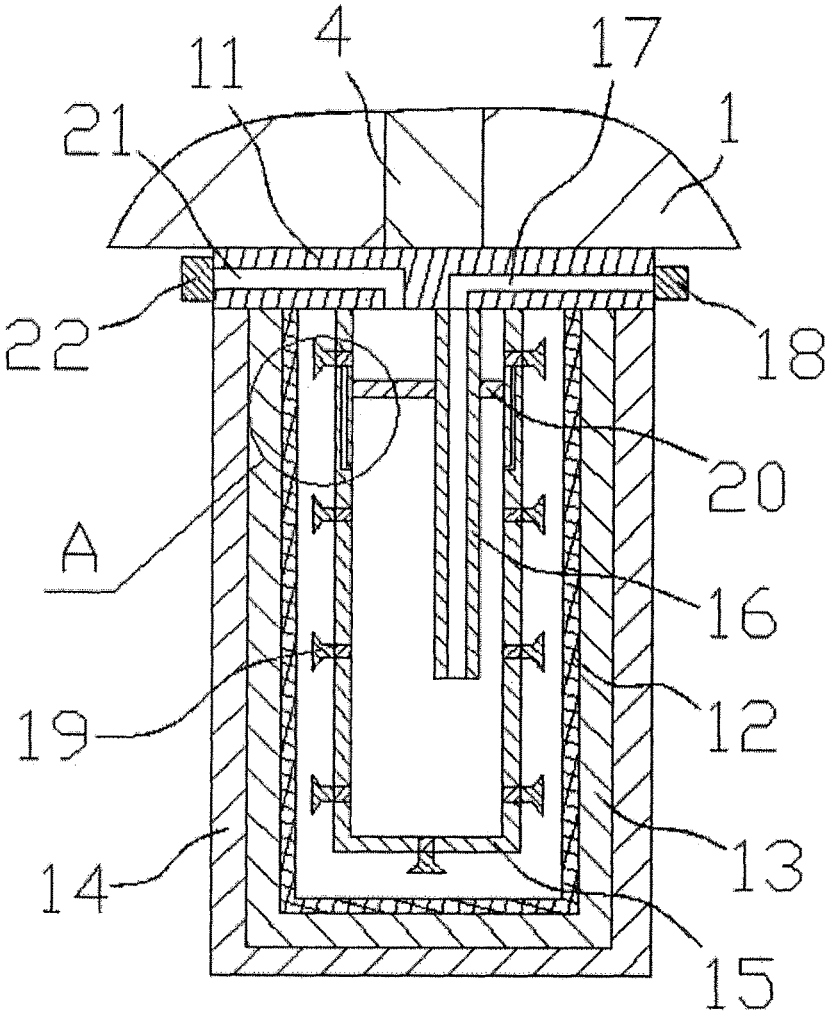
FIG. 3 is a schematic structural view of a cleaning machine.
Figure 4:
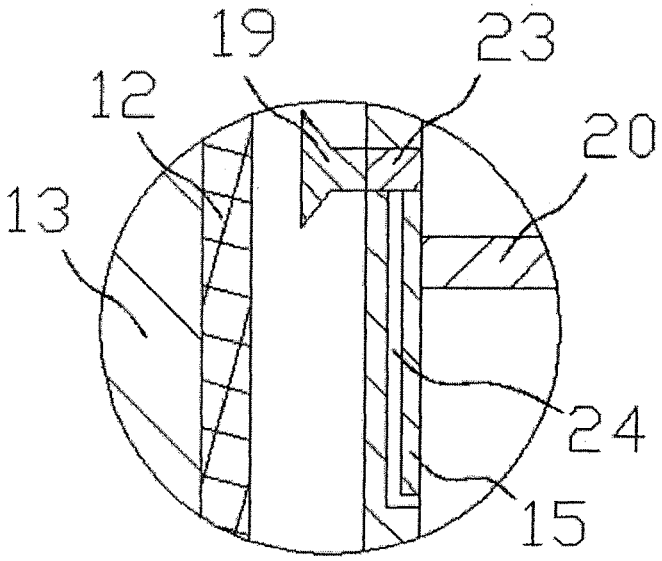
FIG. 4 is a partial enlarged view of A in FIG. 3.
Figure 5:
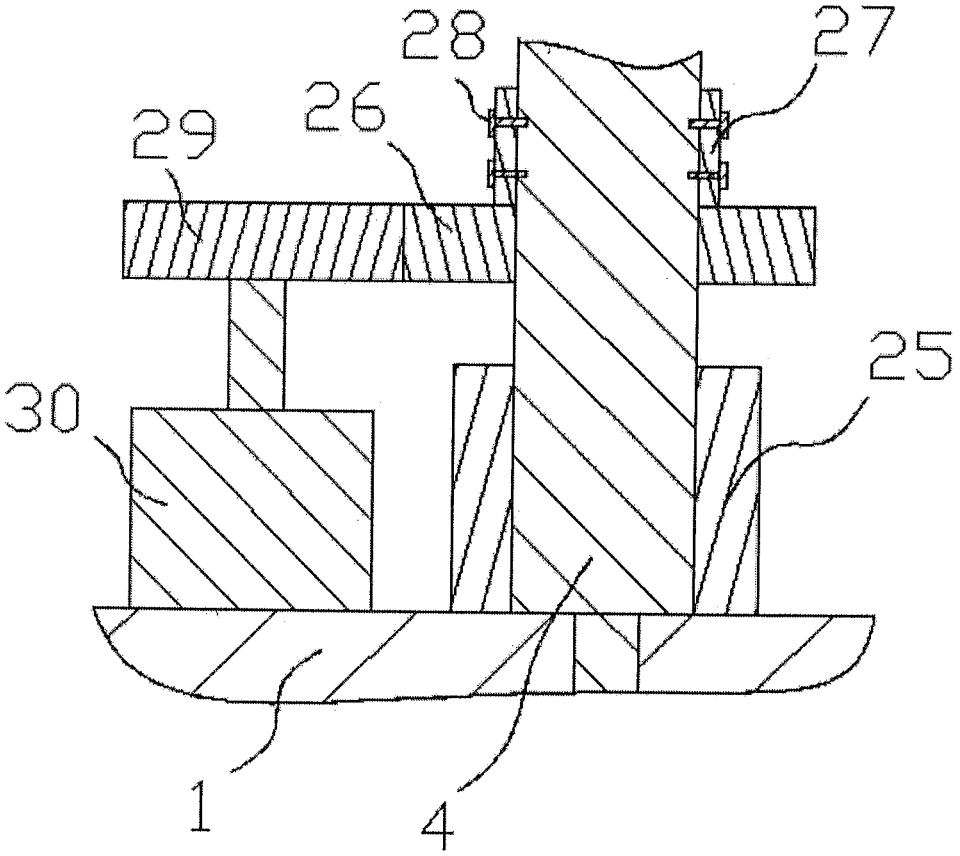
FIG. 5 is a schematic structural view of a cylinder rotating device.
Figure 6:
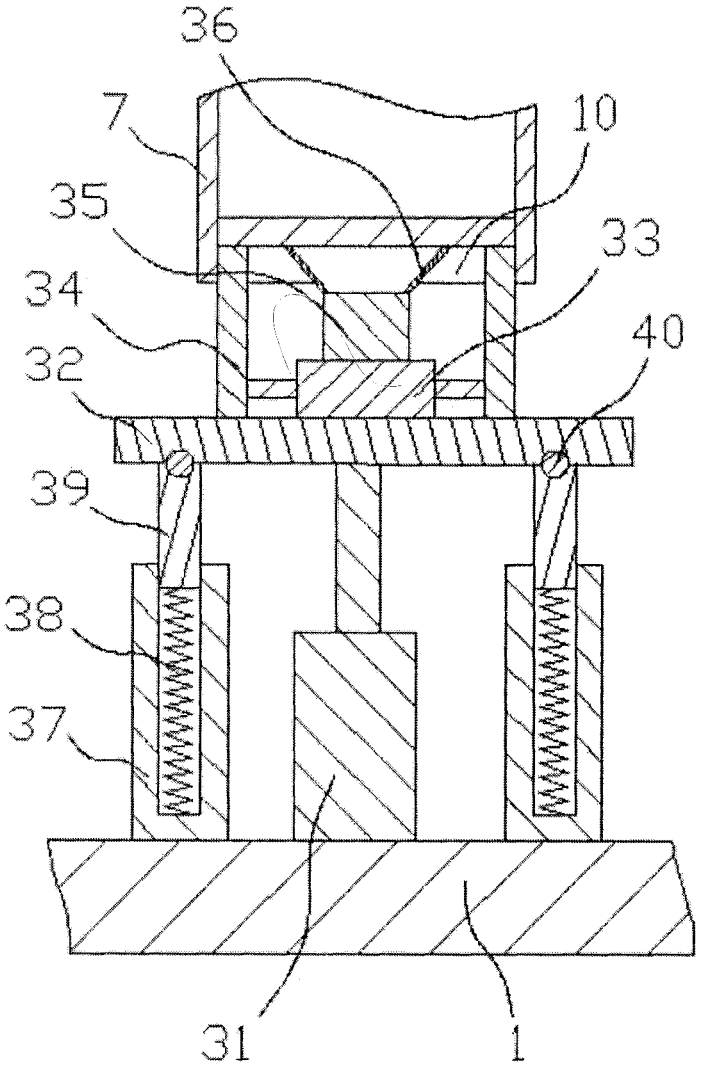
FIG. 6 is a schematic structural view of a fixing device.
Figure 7:
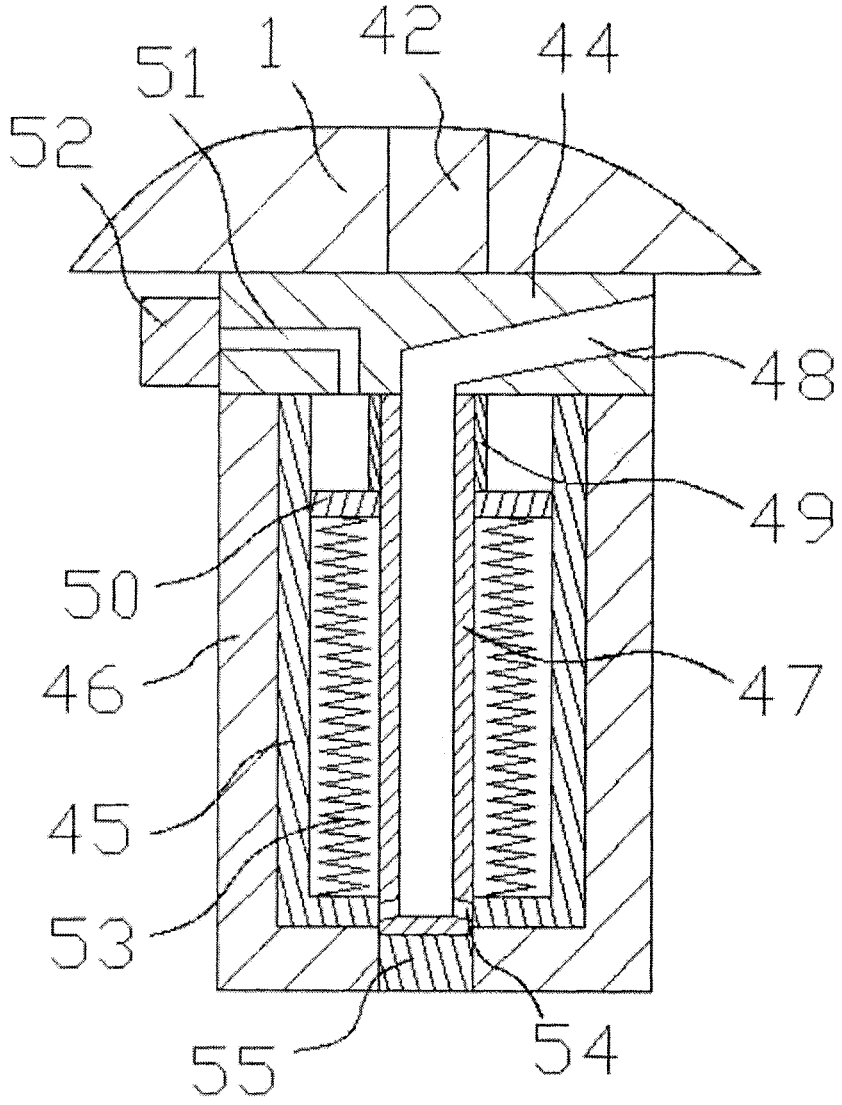
FIG. 7 is a schematic structural view of a drying machine.

As shown in FIGS. 1 to 7, the specific structure of the present invention is:

The paint bucket cleaning and drying integrated machine including a frame 1, the middle part of the frame 1 is disposed with a tightly conveying carrier tape 41 which is conveying from left to right. The conveying carrier tape 41 is disposed with a loading port matched with the paint bucket 3. The upper part of the frame 1 is sequentially provided with a cleaning mechanism and a drying mechanism matched with the paint bucket 3 in the conveying direction. And the frame under the cleaning mechanism and the drying mechanism is provided with a fixing device 2 matching with a fixing cavity 10 disposed under the paint bucket 3. The cleaning mechanism includes a cleaning lift cylinder 4 disposed on the frame 1, a cleaning machine 5 matching with the paint bucket 3 is connected below the cleaning lift cylinder 4, and the cleaning lift cylinder 4 is matched with a cylinder rotating device 6 disposed on the frame 1. The drying mechanism includes a drying lift cylinder 42 disposed on the frame 1, and a drying machine 43 matching the paint bucket 3 is connected under the drying lift cylinder 42, and the drying lift cylinder 42 is matched with the cylinder rotating device 6 disposed on the frame 1.

Preferably, the drying machine 43 includes a drying connect block 44 connected with the drying lift cylinder 42. A drying sleeve 45 is fixedly connected to the bottom of the drying connect block 44. The outer side of the drying sleeve 45 is sleeved with a detachable drying cloth cover 46 matching with the paint bucket 3.

Preferably, the inside of the drying sleeve 45 is a cavity, and a lift plate return spring 53 is disposed at the bottom thereof. The upper part of the lift plate return spring 53 is connected with a discharge tube lift plate 50 sealed with the drying sleeve 45. The middle part of the discharge tube lift plate 50 is fixedly connected with an activated carbon discharge tube 47 penetrating thereof. The bottom of the drying connect block 44 is fixedly connected with a discharge tube sealing sleeve 49 which is sealingly matched with the activated carbon discharge tube 47. And the drying connect block 44 is provided with an activated carbon discharge channel 48 communicated with the activated carbon discharge tube 47 and a discharge tube lift air passage 51 communicated with the drying sleeve 45. The outer end of the discharge tube lift air passage 51 is connected with a discharge tube lift air pump 52, the middle part of the bottom of the drying sleeve 45 and the drying cloth sleeve 46 are respectively provided with holes that are sleeved and matched with the activated carbon discharge tube 47. The lower part of the activated carbon discharge tube 47 is provided with an activated carbon discharge port 54, and the bottom thereof is connected with a drying block 55. The activated carbon discharge port 54 is sealed by the bottom plate of the drying sleeve 45 while the bottom of the drying block 55 is flush with the drying cloth cover 46.

Preferably, the cleaning machine 5 includes a cleaning connect block 11 disposed under the cleaning lift cylinder 4. And a cylindrical cleaning mounting net 12 is fixedly connected under the cleaning connect block 11, the outer side of the cleaning mounting net 12 is sleeved with a sponge layer 13. The outer side of the sponge layer 13 is provided with a brush layer 14, and the brush of the brush layer 14 is connected to the Cleaning mounting net 12 passing through the sponge layer.

Preferably, the part of the cleaning connect block 11 that is located within the cleaning mounting net 12 is sealed and fixedly connected with a water storage tank 15. The water storage tank 15 is provided with a pressurizing plate 20 sealed and matched thereof. The cleaning connect block 11 is provided with a pressurizing air passage 21 matched with the cavity of the water storage tank 15, and the cavity is located above the pressurizing plate 20. The pressurizing air passage 21 is connected with a pressurizing joint 22, the side wall and the lower plate of the water storage tank 15 are embedded with a pressurizing control valve 23, and a liquid spray head 19 is connected with the outer end of pressurizing control valve 23.

Preferably, a liquid supplementing tube 16 passing through the pressurizing plate 20 is disposed under the cleaning connect block 11, and the liquid supplementing tube 16 is sealed and sleeved with the cleaning connect block 11. The cleaning connect block 11 is provided with a liquid supplementing channel 17 communicated with the liquid supplementing tube 16, the liquid supplementing channel 17 is connected with a liquid supplementing joint 18. Preferably, the side wall of the water storage tank 15 is also embedded with a pressurizing control valve 23, and the said side wall is located above the pressurizing plate 20. The pressurizing control valve 23 is communicated with a cavity of the water storage tank 15 through an upper liquid discharge channel 24 disposed on the side wall of the water storage tank 15, and the cavity is located below the pressurizing plate 20.

Preferably, the cylinder rotating device 6 includes a cylinder limit sleeve 25, which is provided on the upper part of the frame 1 and is sleeved and matched with the cleaning lift cylinder 4 or drying lift cylinder 42, and includes a driven gear 26, which is sleeved with the cleaning lift cylinder 4 or drying lift cylinder 42. The upper part of the driven gear 26 is provided with a gear fixing block 27 which is fixedly connected to the side wall of the cleaning lift cylinder 4 or drying lift cylinder 42 through a gear fixing bolt 28. The driven gear 26 is meshed and matched with a drive gear 29, the drive gear 29 is sleeved with a cylinder rotating motor 30 provided on the frame 1.

Preferably, the fixing device 2 includes a fixing lift cylinder 31 disposed under the frame 1, the fixing lift cylinder 31 is provided with a fixing seat 32, and the fixing seat 32 is provided with an inner fixing cylinder 33. The inner fixing cylinder 33 is connected with an inner fixing arc plate 34 matched with the inner wall of the fixing cavity 10. A suction pump 35 is disposed above the inner fixing cylinder 33, and a suction cone sleeve 36 matched with the bottom plate of the bucket 7 is disposed above the suction pump 35.

Preferably, the lower part of the frame 1 is provided with a block support seat 37, the lower part is located under the fixing seat 32. The inside of the said block support seat 37 is provided with a fixing support port, the fixing support port is provided with a fixing support spring 38. And the fixing support spring 38 is provided with a fixing support rod 39, and the lower part of the fixing support rod 39 is provided with a fixing limit ball 40, the lower surface of the fixing seat 37 is provided with a fixing limit arcing port matched with the fixing limit ball 40.

When in specific use, the liquid supplementing joint 18 is connected to the conveying device for paint cleaning solution, and then the paint cleaning solution is supplemented from the liquid supplementing tube 16 to the water storage tank 15.

The pressurizing joint 22 is connected with the pressurizing pump, driving the pressurizing plate 20 to press down, thereby generating pressure on the liquid. Then the pressurized liquid punches the pressure control valve 23 to open, makes the liquid spay head to spay the cleaning solution to the sponger layer. After completion, the connection of the pressurizing joint 22 to the pressurizing pump is disconnected, and the preparation of the cleaning machine 5 is completed. Meanwhile the activated carbon is discharged into the activated carbon discharge tube 47 from the activated carbon discharge channel 48 and the drying cloth cover 46 is set, thereafter the preparation of the drying machine is completed. The conveying carrier tape 41 starts to convey, and the paint bucket 3 is placed in the fixing port to enter the cleaning station by the conveying carrier tape 41. At this time, the fixing lift cylinder 31 of the cleaning station drives the fixing seat 32 to rise, so that the bottom of the paint bucket is covered on the suction cone sleeve.

The inner fixing cylinder drives the inner fixing arc plate to fix the inner side of the bucket body 7, and then the air in the suction cone sleeve 36 is sucked out by the suction pump 35 to make the suction cone sleeve is closely matched with the bottom plate of the bucket body. Then, the cleaning machine 5 is driven into the paint bucket 3 by the cleaning lift cylinder 4, and then is started by the cylinder rotating motor 30 of the cleaning station. The rotating of the two gears drives the cleaning lift cylinder 4 to rotate, thereby rotating the cleaning machine 5, and the brush layer is accompanied by the cleaning solution to scrub the paint bucket. After the cleaning is completed, the cleaning mechanism and the fixing device of the cleaning station are returned to their original position. The conveying carrier belt 41 continues to convey, and the paint bucket 3 is conveyed to the drying station. The fixing device 2 of the drying station and the fixing device 2 of the cleaning station use the same operation to fix the paint bucket 3. The drying machine 43 is driven into the paint bucket 3 by the drying lift cylinder 42, and then is started by the cylinder rotating motor 30 of the drying station. The rotating of the two gears drives the drying lift cylinder 42 to rotate, thereby rotating the drying machine 43, and the cleaned paint bucket 3 is dried ty the drying cloth cover 46 and drying block 55. Then the drying lift cylinder 42 is raised. In above process, the air is filled in the discharge tube lift air passage 51 by the discharge tube lift air pump 52, thereby the air pressure above discharge tube lift plate 50 is greater than the air pressure under the discharge tube lift plate 50, which makes the discharge tube lift plate 50 drive the activated carbon discharge tube 47 to descend together, so that the activated carbon discharge port 54 passes the drying cloth cover from the lower part thereof. The activated carbon placed in the activated carbon discharge tube 47 is dropped from the activated carbon discharge port 54 into the paint bucket to further deodorize the paint bucket. Then the air is exhausted by the discharge tube lift air pump 52, and the discharge tube lift plate 50 is returned to original position thereof by the lift plate return spring 53, thereby completing a drying and discharging of the activated carbon process. In this way, cleaning, drying, and discharging of the activated carbon are continuously and automatically performed.

It is to be, understood that the term "includes", "including" or any other variants thereof is intended to encompass a non-exclusive inclusion, such that a process, method, article, or device that comprises a plurality of elements includes not only those elements. It also includes other elements that are not explicitly listed, or elements that are inherent to such a process, method, item, or device.

The principles and embodiments of the present invention have been described herein with reference to specific examples, and the description of the above examples is only to aid in understanding the method of the present invention and its core idea. The above description is only a preferred embodiment of the present invention, and it should be noted that due to the finiteness of the textual expression, there is an infinitely specific structure objectively, and those skilled in the art can not deviate from the principle of the present invention. In the following, several modifications, modifications or variations may be made, and the above technical features may be combined in an appropriate manner; these improvements, modifications, variations or combinations, or unmodified, directly apply the inventive concept and technical solution to other occasions, all of which should be regarded as the scope of protection of the present invention.

What is claimed is:

1. An integrated paint bucket cleaning and drying system for cleaning and drying an interior portion of a paint bucket, comprising:

a frame comprising at least an upper frame member, a lower frame member, a left side frame member, and a right side frame member;

a conveyor interposed between said upper frame member and said lower frame member, having a plurality of paint buckets mounted upon said conveyor, and extending between said left and right frame members for sequentially moving said plurality of paint buckets from said one of said left and right frame members toward the other one of said left and right frame members;

a cleaning machine mounted upon said upper frame member at a cleaning station for cleaning a paint bucket;

a drying machine mounted upon said upper frame member at a drying station for drying a paint bucket that has been cleaned by said cleaning machine at said cleaning station, said conveyor sequentially moving said plurality of paint buckets between said cleaning station and said drying station;

said cleaning machine comprising a cleaning brush assembly mounted upon a lower end portion of a first linear actuator for moving said cleaning brush assembly from an elevated position at which said cleaning brush assembly is removed from said interior portion of said paint bucket to a lowered position at which said cleaning brush assembly is disposed within said interior portion of said paint bucket so as to clean said interior portion of said paint bucket, a first rotary drive assembly operatively associated with said first linear actuator for rotating said cleaning brush assembly so as to clean said interior portion of said paint bucket, a cleaning connect block disposed beneath said cleaning lift cylinder, a cylindrical cleaning mounting net fixedly connected to an undersurface portion of said cleaning connect block, a sponge layer sleeved around an external peripheral portion of said cleaning mounting net, and a brush layer annularly surrounding said sponge layer and operatively connected to said cleaning connect block; and said drying machine comprising a drying cloth assembly mounted upon a lower end portion of a second linear actuator for moving said drying cloth assembly from an elevated position at which said drying cloth assembly is removed from said interior portion of said paint bucket to a lowered position at which said drying cloth assembly is disposed within said interior portion of said paint bucket so as to dry said interior portion of said paint bucket which has been cleaned by said cleaning brush assembly of said cleaning machine, and a second rotary drive assembly operatively associated with said second linear actuator for rotating said drying cloth assembly so as to dry said interior portion of said paint bucket cleaned by said cleaning brush assembly of said cleaning machine.

2. The paint bucket cleaning and drying integrated machine of claim 1, wherein:

said drying machine comprises a drying connect block connected to said drying lift cylinder;

a drying sleeve is fixedly connected to a bottom portion of said drying connect block; and a detachable drying cloth cover, for disposition within each one of said plurality of paint bucket, annularly surrounds said drying sleeve.

3. The paint bucket cleaning and drying integrated machine of claim 2, wherein:

said drying sleeve defines a cavity therewithin;

an activated carbon discharge tube is disposed coaxially within said cavity defined within said drying sleeve;

an annular discharge tube lift plate is disposed within said cavity defined within said drying sleeve and extends between said activated carbon discharge tube and said drying sleeve so as to seal said cavity defined within said drying sleeve;

an annular lift plate return spring is disposed within said cavity defined within said drying sleeve so as to annularly surround said activated carbon discharge tube wherein upper portions of said annular lift plate return spring are disposed in contact with portions of said discharge tube lift plate while lower portions of said annular lift plate return spring are disposed in contact with annular floor portions of said drying sleeve;

a bottom portion of said drying connect block is fixedly connected to a discharge tube sealing sleeve which annularly surrounds said activated carbon discharge tube;

an activated carbon discharge channel is defined within said drying connect block so as to be in fluidic communication with said activated carbon discharge tube;

a discharge tube lift air passage is also defined within said activated carbon discharge channel so as to be in fluidic communication with said cavity defined within said drying sleeve;

wherein an end portion of said discharge tube lift air passage is in fluidic communication with a discharge tube lift air pump wherein said drying sleeve and said detachable drying cloth cover are respectively provided with apertures that are fluidically aligned with apertures defined within said activated carbon discharge tube;

wherein a lower end portion of said activated carbon discharge tube is provided with an activated carbon discharge port, while a bottom end portion of said activated carbon discharge tube is connected to a drying block; and wherein said activated carbon discharge port is sealed by a bottom floor plate of said drying sleeve while a bottom end portion of said drying block is flush with a bottom end portion of said detachable drying cloth cover.

4. The paint bucket cleaning and drying integrated machine of claim 1, wherein:

a water storage tank is disposed internally within said cleaning mounting net and is fluidically sealed to an undersurface portion of said cleaning connect block;

a pressurizing plate is disposed within an upper region of said water storage tank, and said cleaning connect block has a portion thereof extending downwardly into said water storage tank so as to pass through said pressurizing plate of said water storage tank;

said cleaning connect block is provided with a pressurizing air passage which is fluidically connected at one end thereof to an interior portion of said water storage tank which is located above said pressurizing plate, while an opposite end of said pressurizing air passage is connected to a pressurizing joint; and wherein side wall portions, and a lower end wall portion of said water storage tank, are provided with a plurality of first liquid spray heads and a plurality of first pressurizing control valves for controlling the discharge of cleaning water from said plurality of spray heads, all of which are located beneath said pressurizing plate.

5. The paint bucket cleaning and drying integrated machine of claim 4, wherein; said portion of said cleaning connect block extending downwardly into said water storage tank and passing through said pressurizing plate comprises a liquid supplementing tube a liquid supplementing channel is defined within said cleaning connect block and is fluidically connected at one end thereof to said liquid supplementing tube; and said liquid supplementing channel is fluidically connected at an opposite end thereof to a liquid supplementing joint.

6. The paint bucket cleaning and drying integrated machine of claim 4, wherein:

side wall portions of said water storage tank, disposed above said pressurizing plate, are provided with a plurality of second liquid spray heads and a plurality of second pressurizing control valves; and said plurality of second pressurizing control valves are fluidically connected to said water storage tank a plurality of upper liquid discharge channels defined within upper side wall portions of said water storage tank, wherein fluid inlets of said plurality of upper liquid discharge channels are disposed beneath said pressurizing plate.

7. The paint bucket cleaning and drying integrated machine of claim 1, wherein:

said first rotary drive assembly comprises a first cylinder limit sleeve which is mounted upon said upper frame member, is sleeved around said first linear actuator, comprises a driven gear which is sleeved around said first linear actuator, and further comprises a gear fixing block which is fixedly connected to, and annularly surrounds, an external side wall portion of said first linear actuator; and wherein further, said driven gear is enmeshed with a drive gear, while said drive gear is operatively connected to a rotary motor which is mounted upon said upper frame member.

8. The paint bucket cleaning and drying integrated machine of claim 1, further comprising: a fixing device comprising a fixing lift cylinder mounted upon said lower frame member, and a fixing seat disposed atop said fixing lift cylinder, wherein said fixing seat is provided with an inner fixing cylinder; said inner fixing cylinder is connected to an inner fixing arc plate which, in turn, is disposed with a fixing cavity defined beneath each one of the plurality of paint buckets; a suction pump is disposed above said inner fixing cylinder; and a conical suction cone sleeve adapted to be interposed between a bottom plate of each one of said plurality of buckets and said suction pump.

9. The paint bucket cleaning and drying integrated machine of claim 8, wherein:

a material support seat is fixedly mounted upon said lower frame member and is located beneath a fixing seat;

said material support seat has a fixing support bore defined therein, and a material support spring is disposed within said material support bore;

said material support spring is operatively engaged with a lower end portion of a material support rod, while an upper end portion of said material support rod is provided with a material limit ball; and a lower surface portion of said fixing seat is provided with a material limit arcing port for accommodating said material limit ball.

10. The paint bucket cleaning and drying integrated machine of claim 1, wherein:

said second rotary drive assembly comprises a second cylinder limit sleeve which is mounted upon said upper frame member, is sleeved around said second linear actuator, comprises a driven gear which is sleeved around said second linear actuator, and further comprises a gear fixing block which is fixedly connected to, and annularly surrounds, an external side wall portion of said second linear actuator; and wherein further, said driven gear is enmeshed with a drive gear, while said drive gear is operatively connected to a rotary motor which is mounted upon said upper frame member.

* * * * *